United States Patent [19]

Rasor

[11] Patent Number: 4,766,621

[45] Date of Patent: Aug. 30, 1988

[54] FISHERMAN'S PORTABLE SINK

[76] Inventor: Cecil E. Rasor, P.O. Box 690-683, Tulsa, Okla. 74169

[21] Appl. No.: 893,716

[22] Filed: Aug. 6, 1986

[51] Int. Cl.[4] ..... A47K 1/05

[52] U.S. Cl. ..... 4/643; 4/638; 4/631; 114/343

[58] Field of Search ..... 4/631–635, 4/637, 638, 643–649, 660, 630; 248/214, 165; 114/343, 364, 188; 312/228; 108/48

[56] References Cited

U.S. PATENT DOCUMENTS

| | | | |
|---|---|---|---|
| 599,706 | 3/1898 | Heineken | 4/644 |
| 832,182 | 10/1906 | Dimond | 4/648 |
| 1,480,145 | 1/1924 | Berven . | |
| 2,898,606 | 8/1959 | Feller . | |
| 3,057,670 | 10/1962 | Russo | 108/48 |
| 3,292,966 | 12/1966 | Mariol | 4/644 |
| 3,324,483 | 6/1967 | Conroy | 4/638 |
| 3,333,282 | 8/1967 | Mustee | 248/165 |
| 3,444,565 | 5/1969 | Anklin . | |
| 3,594,830 | 7/1971 | Clifton . | |
| 4,085,473 | 4/1978 | Franklin | 114/364 |
| 4,597,077 | 2/1985 | Provost . | |

FOREIGN PATENT DOCUMENTS

| | | | |
|---|---|---|---|
| 324455 | 8/1920 | Fed. Rep. of Germany | 4/644 |
| 1417610 | 10/1965 | France | 4/647 |
| 857461 | 12/1960 | United Kingdom | 4/643 |

*Primary Examiner*—Henry J. Recla
*Assistant Examiner*—Linda J. Sholl
*Attorney, Agent, or Firm*—Robert B. Stevenson

[57] ABSTRACT

A lightweight, manually portable, fisherman's sink comprising a rectangular plastic working surface with integrally fabricated recessed sink and sidewalls that extend above and below the working surface. The sink is further equipped with a cutting board and water delivery system (e.g., electric or manual pump and faucet or spray nozzle) for withdrawing water from the lake, river or the like to clean fish. The rectangular sink is equipped with a novel combination of support mechanisms including removable legs at each corner, a plurality of notched openings on the lower edge of the sidewalls with locking means to attach to the handrail of a boat or fishing dock, and a pivotally attached adjustable leg and bracket system for suspending the sink from a bass boat handrail.

3 Claims, 3 Drawing Sheets

FISHERMAN'S PORTABLE SINK

BACKGROUND OF THE INVENTION

1. Field of the Invention

This invention relates to a manually portable fisherman's sink. More specifically, this invention relates to a fisherman's sink that can be employed on a fishing dock or on a fishing boat by virtue of the presence of a novel combination of support mechanisms.

2. Description of the Prior Art

The basic concept of providing a portable sink for camping and the like is generally known. However, the problems associated with cleaning fish and particularly the mess and inconvenience associated with disposing of waste associated with the cleaning of fish tend to make the prior art portable sinks impractical for this specific task. Ideally, the fisherman would require a highly portable, lightweight sink that would conveniently attach to a boat or fishing dock as well as be free standing, yet still provide all the essential convenience of a conventional kitchen sink such that the fish cleaning process can be performed at the location that the fish are caught. To the best knowledge of the present Inventor, no such device has been discovered or perfected prior to the present invention.

SUMMARY OF THE INVENTION

In view of the problems associated with the prior art, the present invention provides a highly portable and convenient fisherman's sink that can be used in a free standing configuration, attached to the handrails of a boat dock, pontoon boat or the like, or suspended from the handrail of a bass boat and extend over the water. The fisherman's sink is further designed to utilize the water from the lake or river to clean the fish. Thus, the present invention provides a manually portable fisherman's sink comprising:

(a) a unitary rigid, plastic fabricated rectangular sink consisting of an essentially flat surface adapted to be held substantially horizontal during use, wherein the essentially flat surface contains at least one integrally fabricated sink bowl recessed downwardly relative to the horizontal flat surface during use and therein the periphery of the essentially flat surface is completely encircled with integrally fabricated sidewalls that extend vertically above the essentially flat surface during use to retain liquid and extend vertically below the essentially flat surface during use and terminate at the lower extremity of the sidewall with a plurality of notched openings adapted to receive and hold a handrail therein;

(b) a cutting board mounted to the top side of the essentially flat surface;

(c) a water delivery system means for withdrawing water from a natural source, delivering the water to the rectangular sink for cleaning fish and returning the water to the natural source;

(d) four removable legs and leg engaging means wherein one of each of the leg engaging means is located at each of the four corners of the rectangular sink;

(e) a pair of legs and brackets wherein one of the legs and one of the brackets are pivotally attached to a first sidewall and adjustably engaged to each other and wherein the other of the legs and the other of the brackets are pivotally attached to a second sidewall opposite the first sidewall and adjustably engaged to each other such as to support the rectangular sink by having the notched openings receive and hold a handrail and the legs make contact with the sidewall below the handrail; and (f) a plurality of locking means attached to the underside of the essentially flat surface and positioned such as to fasten to the handrail being held in one or more of the plurality of notched openings.

It is an object of the present invention to provide a portable fisherman's sink that can be manually carried to and used at the fishing location. It is a further object to provide such a sink that can be used in a free standing configuration or attached to the handrail of a fishing dock or pontoon boat as well as suspended outwardly over the water from the handrail of a bass boat or the like. Fulfillment of these objects and the presence and fulfillment of additional objects will become apparent upon complete reading of the specification and claims taken in conjunction with the attached drawings.

DESCRIPTION OF THE PREFERRED EMBODIMENTS

Figure 1:
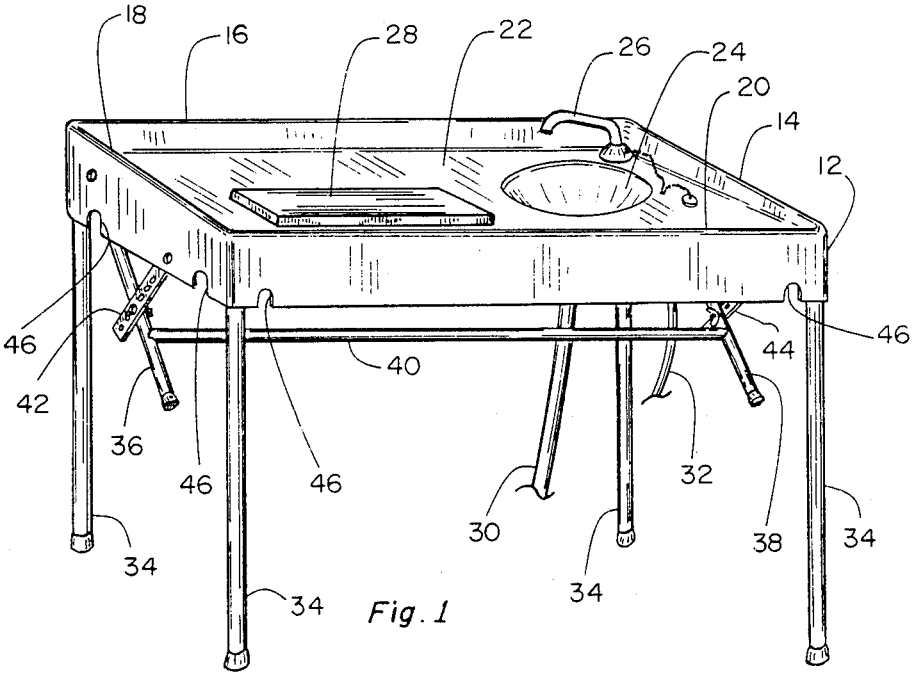
FIG. 1 is a perspective view of the fisherman's portable sink according to the present invention.

The novel fisherman's portable sink according to the present invention, how it functions and how it differs from as well as its advantages over the prior art can perhaps be best explained and understood by reference to the drawings. For example, FIG. 1 illustrates one specifically preferred embodiment of the portable fisherman's sink according to the present invention, generally designated by the numeral 10. As illustrated, the portable sink 10 involves a lightweight rectangular plastic tabletop 12 consisting of essentially four vertical sidewalls 14, 16, 18 and 20 that extend upwardly beyond the otherwise essentially horizontal surface 22; thus, forming a lip around the outer edge of the tabletop 12. In this manner, the table can be readily washed and rinsed without spillage or dripping. In one corner of the tabletop 12, recessed below the surface 22, is a sink 24. A water tap or spigot 26 is adjacent to sink 24 and a flat cutting board 28 is conveniently mounted to the surface 22 to the side of the sink 24, thus completing the working surface upon which the fisherman can clean fish or the like.

As further illustrated in FIG. 1, the sink bowl 24 is equipped with a drain hose 30 and the faucet spigot 26 is attached to a water inlet tube 32. At each corner of the tabletop 12 is a removable vertical leg 34 which represents one of three different kinds or types of support mechanisms employed in the portable sink according to the present invention. A second kind of support mechanism involves a pair of adjustably mounted legs 36 and 38 with cross support 40 pivotally attached to the sidewalls 14 and 18, respectively, and held in place by adjustable brackets 42 and 44. These adjustable legs 36 and 38 are used in combination with the plurality of notched openings 46 found on the lower lip of the sidewalls and pivotal locking mechanisms 48 (see FIG. 3) found on the underside of the tabletop surface 22 to support the sink 10 on a single handrail on a boat or ship as explained later. These same notched openings 46 found on the lower lip of the sidewalls are used in combination with pivotal locking mechanism 74 (again see FIG. 3) found on the underside of the horizontal tabletop surface 22 as a third type of support mechanism, again as explained later.

Figure 2:
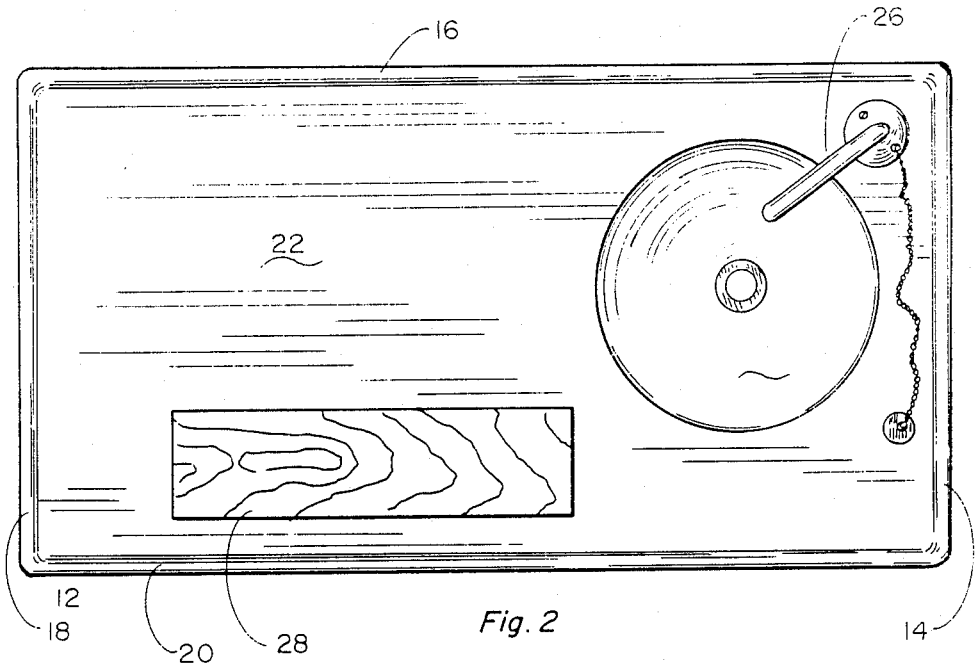
FIG. 2 is a top view of the fisherman's portable sink of FIG. 1.
Figure 3:
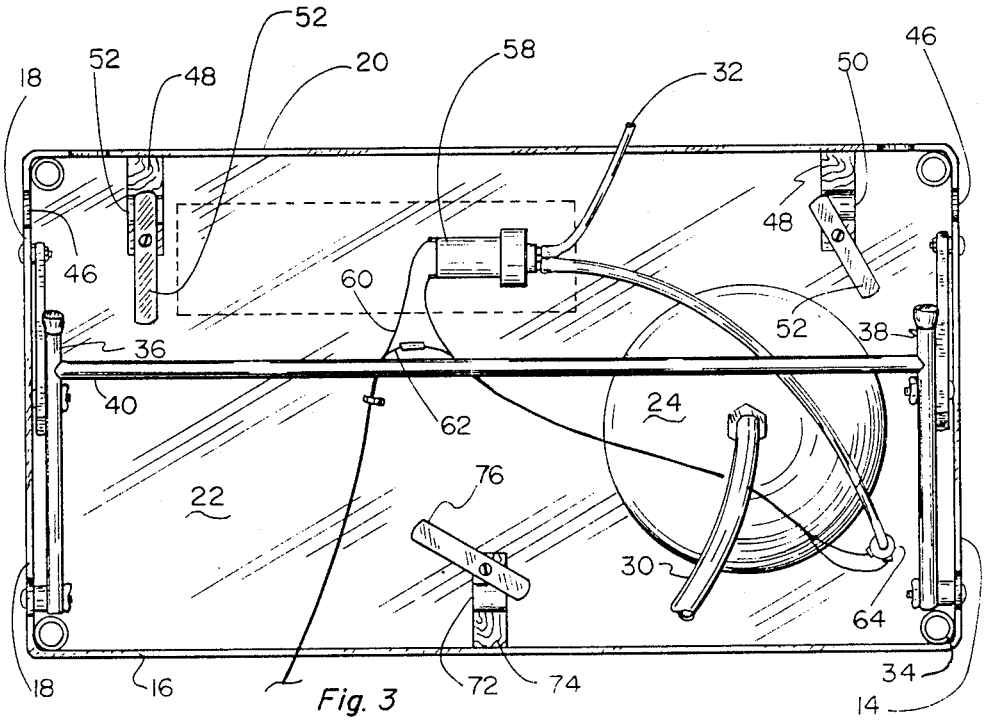
FIG. 3 is a bottom view of the fisherman's portable sink of FIG. 1.

As seen in FIGS. 2 and 3, the tabletop 12 is preferably a thin, lightweight, plastic sheet that has the vertical sidewalls 14, 16, 18 and 20 as well as the horizontal surface 22 and recessed sink bowl 24 molded or otherwise fabricated into a single unit. As such, plastic fabrication techniques such as injection molding, compression molding with plug and die, vaccum forming, vaccum forming with mechanical assist, fiber reinforced plastic layup procedures and the like are useful in manufacturing the tabletop 12 according to the present invention. As seen in the underside view of FIG. 3, the notched openings 46 nearest the sidewall 20 are aligned with notches 50 found in the locking mechanisms 48 mounted to the underside of surface 22. Each locking mechanism 48 is further equipped with a pivoting latch 52 that locks or fastens to the handrail (not shown) passing through the aligned openings 46 and 50. In this support configuration, the entire portable sink 10 pivots about the handrail 54 (see FIG. 4) until the protective capped ends of the adjustable legs 36 and 38 making contact with the exterior side 56 of the boat to which the handrail is mounted.

Figure 7:
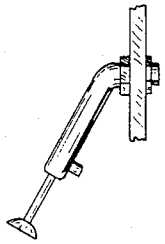
FIG. 7 illustrates a hand pump alternate embodiment to the faucet spigot of the fisherman's portable sink of FIG. 1.
Figure 8:
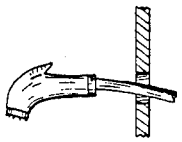
FIG. 8 is a spray nozzle alternate embodiment to the faucet spigot of the fisherman's portable sink of FIG. 1.

The underside view of FIG. 3 also shows the presence of an electric water pump 58 mounted to surface 22 in the vicinity of the cutting board 28 (illustrated as dashed lines) for structural support and vibration dampening. Electrical leads 60 and 62 are attached to one end of a storage battery (not shown). Electrical lead 60 goes to one side of pump 58, while electrical lead 62 goes to an off-on switch 64 circumferentially mounted to the faucet 26. An electrical lead 66 completes the low voltage wiring by attaching to the other lead of switch 64 and the other terminal of pump 58. In this manner, and for purposes of the specific embodiment illustrated in FIGS. 1 through 6, the water is turned on by swinging or pivoting the faucet spigot 26 over the sink bowl 24 and is turned off by swinging the faucet spigot 26 to either side of the sink bowl 24. It should be appreciated that other types of faucets, spigots or nozzles can be employed in combination with the portable fisherman's sink according to the present invention and as such, are to be considered equivalent for purposes of this invention. For example, and as illustrated in FIG. 7, the pump can be a manual pump wherein no electrical switch is required or, in the alternative, the pump can be a nozzle on the end of a flexible hose as illustrated in FIG. 8 which would preferably operate in conjunction with an electric pump and appropriate switch (not shown).

Figure 4:
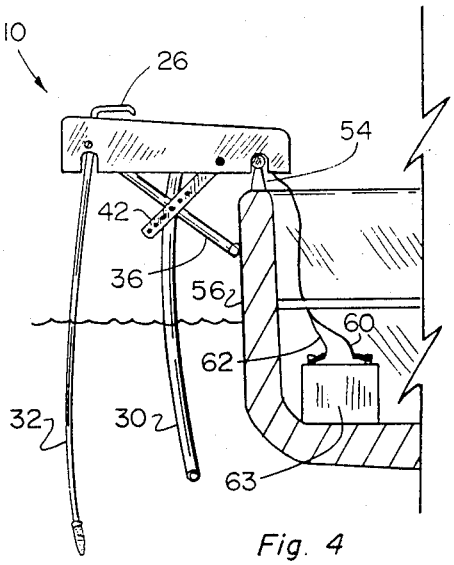
FIG. 4 is a partial cut-away view showing the fisherman's portable sink of FIG. 1 mounted externally on the handrails of a bass boat.
Figure 5:
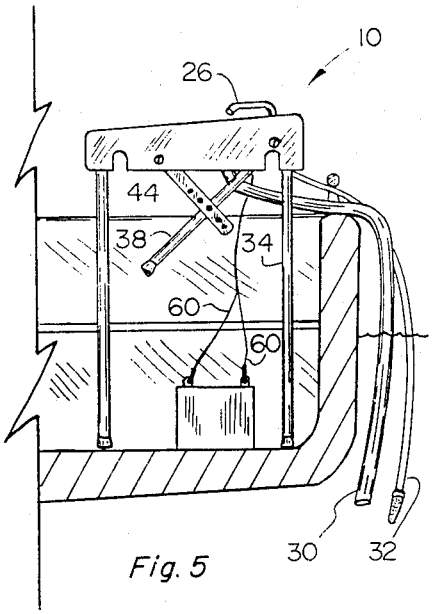
FIG. 5 is a partial cross-sectional view of the fisherman's portable sink of FIG. 1 supported on removable legs within a boat.
Figure 6:
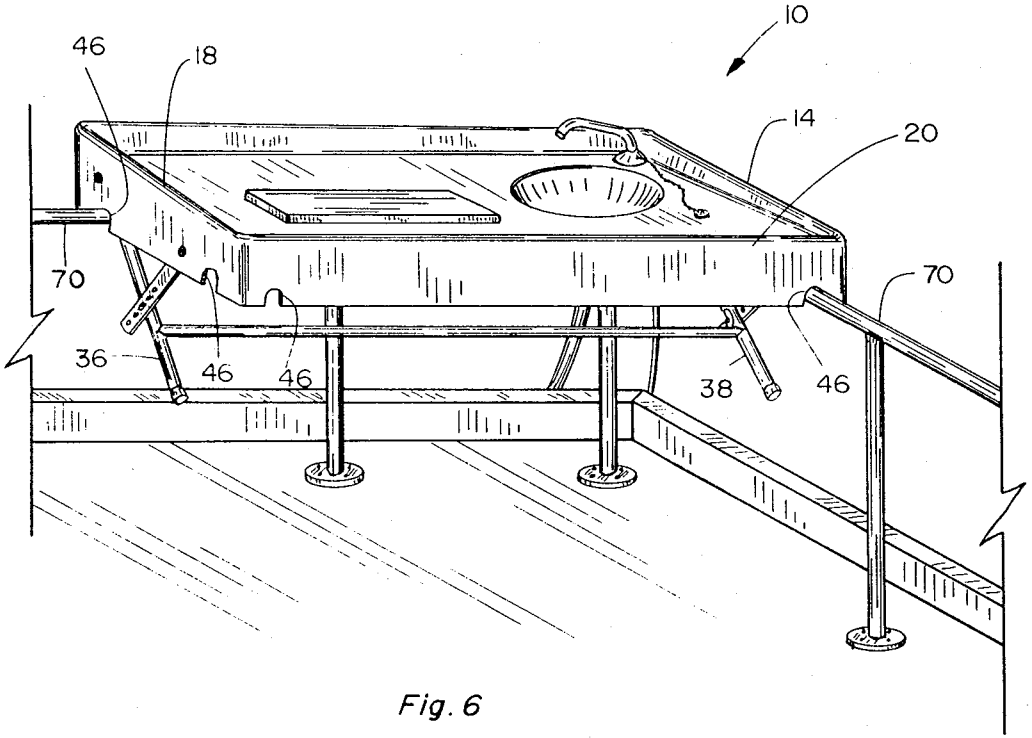
FIG. 6 is a partial cross-sectional view of the fisherman's portable sink of FIG. 1 mounted to the handrails in the corner of a pontoon boat.

The actual installation and use of the fisherman's portable sink according to the present invention is illustrated in FIGS. 4 through 6. As previously described, the detachable legs 34 can be removed and the device can be positioned over the handrail of a bass boat or the like extending outwardly over the water as shown in FIG. 4. In this configuration, the legs 36 and 38 are adjusted on brackets 40 and 42 such as to make contact with the exterior side 56 of the boat and thus, hold the table 12 in an essentially horizontal configuration. The sink discharge hose 30 drops downward into the water while the water pickup tube 32 similarly extends well down below water level. Electrical leads 60 and 62 connect to battery 68 within the boat completing the installation.

FIG. 5 shows an alternate method of supporting the fisherman's portable sink within a boat or on a dock and the like, wherein the detachable legs 34 are used to support the sink. In all other respects, the sink is installed in a manner analogous to that shown in FIG. 4. Similarly, FIG. 6 shows a third alternate method of supporting the fisherman's portable sink 10 in the corner of the handrails 70 of a pontoon boat or the like. In this configuration, neither the removable legs 34 nor the adjustable legs 36 and 38 are required. Instead, the handrail 70 of the pontoon boat passes simultaneously through one notch opening 46 on the front sidewall 20 and one notched opening 46 on either sidewall 14 or 18. On the underside of the sink 10 (see FIG. 3), the pontoon boat rails 70 (not shown) pass through notched opening 72 of locking mechanism 74 and is secured in place by latch 76, thus supporting the sink in the corner of the handrails. This configuration shown in FIG. 7 can also be employed in the corner of a fishing dock or the like provided handrails are present.

It should be further appreciated that various methods of fastening, locking or securing the handrails to the underside of the sink can be employed as alternatives to the locking mechanisms or locking means 48 and 74 specifically illustrated in the preferred embodiment. Similarly, various alternative methods, as generally known in the art, for attaching removable legs to the four corners of the tabletop can also be employed in the present invention. Thus, the legs can be, for example, but not limited thereto, threaded into sockets, sleeved into sockets with a ball and detent or other fastener means and the like. Also, it is contemplated that the legs preferably be telescopic or otherwise adjustable in length such as to be compatible with various heights of handrails and the like. Thus, it can be seen that the portable fisherman's sink according to the present invention is a highly versatile unit compatible with being used in a free standing configuration and reversible mounting configuration to various types of handrails commonly found on fishing boats, fishing docks and the like, yet the device can be readily broken down and manually carried conveniently by a single fisherman.

Having thus described the invention with a certain degree of particularity, it is manifest that many changes can be made in the details of construction and the arrangement of components without departing from the spirit and scope of this disclosure. Therefore, it is to be understood that the invention is not limited to the embodiments set forth herein for the purposes of exemplificaticn, but is to be limited only by the scope of the attached claims, including a full range of equivalents to which each element thereof is entitled.

I claim:

1. A manually portable fisherman's sink comprising:

(a) a unitary rigid, plastic fabricated rectangular sink consisting of an essentially flat surface adapted to be held substantially horizontal during use, wherein said essentially flat surface contains at least one integrally fabricated sink bowl recessed downwardly relative to said horizontal flat surface during use and wherein the periphery of said essentially flat surface is completely encircled with integrally fabricated sidewalls that extend vertically above the esentially flat surface during use to retain liquid and extend vertically below said essentially flat surface during use and terminate at the lower extremity of the sidewall with a plurality of notched means for receiving and holding a handrail therein;

(b) a cutting board mounted to the top side of said essentially flat surface;

(c) a water delivery system means for withdrawing water from a natural source, delivering the water to said rectangular sink for cleaning fish and returning the water to the natural source;

(d) four removable legs and leg engaging means wherein one of each of said leg engaging means is located at each of the four corners of said rectangular sink;

(e) a pair of leg and bracket means wherein one of said leg and brackets means is pivotally attached to a first sidewall and adjustably engaged and wherein the other of said leg and bracket means is pivotally attached to a second sidewall opposite said first sidewall and adjustably engaged such as to support said rectangular sink by having said notched means receive and hold a handrail and said leg and bracket means making contact with the sidewall below the handrail: and (f) a plurality of locking means attached to the underside of said essentially flat surface and positioned such as to fasten to the handrail being held in one or more of said plurality of notched openings.

2. A manually portable fisherman's sink of claim 1 wherein said plurality of notched openings consist of two openings on each sidewall to which said legs and brackets are pivotally attached and two more notched openings on the sidewall most remote from the position of the pivotal attachment of said pair of legs.

3. A manually portable fisherman's sink of claim 2 wherein said plurality of locking means consists of a pair of locking means aligned between said notched openings on opposite sidewalls to which said legs and brackets are pivotally attached and most remote from the position of attachment of said pair of legs and one locking means aligned between said notched opening on opposite sidewalls to which said legs and brackets are pivotally attached and closest to the position of pivotal attachment of said pair of legs.

* * * * *